United States Patent [19]

Lomasney et al.

[11] 4,101,692

[45] Jul. 18, 1978

[54] METHOD FOR RAPID CURING OF PARTIALLY HYDROLYZED SILICATE FILM

[75] Inventors: Henry L. Lomasney; William J. Lomasney, both of New Orleans, La.; Ignatius Metil, Buffalo, N.Y.; Dickens M. Lagos, Gretna, La.

[73] Assignee: Southern Imperial Coatings Corporation, New Orleans, La.

[21] Appl. No.: 801,307

[22] Filed: May 27, 1977

[51] Int. Cl.[2] ..... B05D 3/10

[52] U.S. Cl. ..... 427/333; 427/403

[58] Field of Search ..... 427/333, 403

[56] References Cited

U.S. PATENT DOCUMENTS

| | | | |
|---|---|---|---|
| 3,653,930 | 4/1972 | Law et al. | 106/14 X |
| 3,660,119 | 5/1972 | Oken | 106/14 X |
| 3,853,577 | 12/1974 | Nishida et al. | 427/270 |

*Primary Examiner*—James R. Hoffman

*Attorney, Agent, or Firm*—Roylance, Abrams, Berdo & Farley

[57] ABSTRACT

There is disclosed a method for the rapid curing of a partially hydrolyzed silicate film via the application of an aqueous coating. The aqueous coating composition comprises an epoxy resin and a curing agent, one of which is in an emulsion, and a hydraulic cement. Anions contained in the coating function as an alkaline catalyst causing a rapid polymerization of condensed silicates.

8 Claims, No Drawings

METHOD FOR RAPID CURING OF PARTIALLY HYDROLYZED SILICATE FILM

This invention relates to a method for affecting rapid curing of a partially hydrolyzed silicate film via the application of an aqueous coating.

It is well known that ethyl silicate will react with water and hydrolyze to silica, and it has been proposed that silicate materials be used either by itself or with added pigments and fillers as a paint. It is also known to use partially hydrolyzed ethyl silicate in a paint so that when the paint is spread out in a thin film, it will absorb atmospheric moisture to complete the hydrolysis of the ethyl silicate. Such silicate compositions have been used as binders for coating compositions such as zinc dust paints.

It is frequently advantageous to be able to top coat a partially hydrolyzed silicate primer with a protective coating soon after application of the primer coating. However, since the partially polymerized silicate cures by absorption of moisture from the air, if the protective coating is put on before the primer has completely hardened, the primer will not cure completely since moisture cannot readily permeate the top coat and the resultant coating will be defective, e.g., premature coating failure will result. This problem cannot be overcome simply by top coating the partially hydrolyzed silicate primer coating with an aqueous system such as an aqueous epoxy composition, whereby the water in the system would supplement the atmospheric moisture, since conventional water-borne emulsified epoxies tend to pinhole excessively, offsetting the rather limited effect on the silicate-type coating.

It is an object of this invention to provide a protective coating which will itself force cure or accelerate the cure rate of a partially hydrolyzed silicate primer. This, and other objects are achieved by the practice of this invention which comprises top coating a partially hydrolyzed silicate coating on a substrate with a protective coating comprising an epoxy resin and a curing agent, one of which is in an emulsion, and a hydraulic cement.

It has previously been proposed in the art to combine an epoxy resin emulsion and cement. Thus, U.S. Pat. No. 3,310,511 to Reinart discloses cements, mortars, and similar materials obtained by combining hydraulic cements and emulsified polymerizable epoxy resins. As soon as water is available to the cement, either from the emulsion or additional water which may be added, the cement begins to hydrate.

U.S. Pat. No. 3,853,577 to Nashida, et al discloses the preparation of sprayable, decorative coatings comprising an epoxy resin in the form of an oil in water emulsion and epoxy hardener such as a polyamide, Portland cement and an aggregate powder. The excess water present in the epoxy resin emulsion serves as the moisture which is required.

Neither of the aforementioned patents suggest a means for accelerating the cure rate of a plurality hydrolyzed silicate film.

The partially hydrolyzed silicate is preferably partially hydrolyzed ethyl silicate although other alkyl silicates, wherein the alkyl groups contained from 1 to 8 carbon atoms, such as methyl silicates, propyl silicates, butyl silicates, hexyl silicates and octyl silicates can also be employed, either alone or in admixture. The partially hydrolyzed silicate is preferably applied as a primer coating from an anhydrous vehicle and it may include particulate solids such as zinc dust. Suitable compositions are disclosed in U.S. Pat. Nos. 3,392,036; 3,660,119; and 3,653,930, the disclosures of which are incorporated herein by reference.

The top coating composition comprises an epoxy resin and a curing agent for said epoxy resins, at least one of which components is emulsified, and a hydraulic cement. The amount of epoxy resin and curing agent preferably comprises from 15–80% by weight of the total solids content of the composition. The composition also preferably contains a lignosulfonate hydrate inhibiting agent.

The epoxy resins which are suitable for use in all embodiments of this invention are well known in the art. An example is the diglycidyl ether of bisphenol A, normally formed a a condensation product of epichlorohydrin and bisphenol A [i.e., bis(4-hydroxyphenyl) dimethylmethane]. Condensation products of epichlorohydrin with other polyhydric alcohols may also be used such as diglycidyl ether of bisphenol F [i.e., 4,4'-dihydroxybiphenyl]. Other suitable epoxy resins include epoxidized glycerin dialiphatic esters, 1,4'-bis(2,3-epoxy-propoxy)benzene; 1,3-bis(2,3epoxy-propoxy)-benzene; 4-4'-bis(2,3-epoxy-propoxy)diphenylether; 1,8-bis(2,3-epoxy-propoxy)octane; 1,4'-bis(2,3-epoxy-propoxy)cyclohexane; 4,4-bis(2-hydroxy-3,4'-epoxy-butoxy)-2-chlorocyclohexane; 1,3-bis(2-hydroxy-3,4-epoxy-butoxybenzene)and 1,4-bis(2-hydroxy-4,5-epoxy-pentoxy)benzene. The sole requirement is that the resin solution or the hardener component must be emulsifiable.

Suitable epoxy hardeners are also well known in the art. Thus, any curing agent which is normally used to cross link a bisphenol-A-epichlorohydrin resin, such as polyfunctional amine, a polyfunctional amine adduct, a blocked amine, e.g., a ketimine or a polyamide may be used. Various other epoxy resin curing agents are set forth in the aforementioned Reinert and Nashida et al U.S. patents, the disclosures of which are incorporated herein by reference. It may be desirable to emulsify the hardener rather than the epoxy polymer — in such case the hardener component must be emulsifiable.

Cements which may be used in the practice of this invention include Portland cement, high alumina cement, low alkali cement, high early strength cement or similar hydrate forming materials. The cement may be used alone as the sole additional constituent of the binder or in conjunction with silica flower and other extender pigments. Some such extender pigments are conventionally used in paint formulations such as magnesium and aluminum silicates.

Protective coatings used in the process of this invention are generally applied at low viscosities, often by spraying. However, it is often necessary that they must remain intact on both vertical and overhead surfaces. Therefore, it is sometimes desirable to include a thickening agent which will impart thixotropy to the coating. Such additives include fine particle asbestos, hydroxy ethyl cellulose, amine treated clay and air floated silica. Other materials which are normally used in paint formulating to impart thixotropy can also be used. Organic thinners such as tetrahydrofurfuryl alcohol which may react into the polymer matrix may also be included. The coating compositions may also be applied by spraying or by using a brush or roller. It is preferred that the thickness of the coating be at least 5 mils.

The lignosulfonate hydrate inhibiting agent which may be used in the practice of this invention is a metallic sulfonate salt made from the lignin of sulfite pulp mill liquors and has a molecular weight of from 1000 to 20,000. Examples of such compounds are calcium and sodium lignosulfonates.

The top coat composition may also contain a marine organometallic antifouling compound such as tributyltin oxide, tributyltin acetate or tributyltin fluoride.

The composition outlined herein can be produced in a very high solids range, e.g., above 60%. Consequently, resistance to pinholing is excellent. Moreover, the hydraulic cement has anions which function as alkaline catalysts. This combination, along with the water that is present, causes a rapid polymerization of the condensed silicate.

The following example illustrates the practice of this invention. In this example, all percentages and parts are by weight.

EXAMPLE

| | | |
|---|---|---|
| Base | Epoxy-Shell 828 | 11.92 |
| | Pluronic (18% in water) | 0.76 |
| | Balab 748 (Antifoam) | 0.19 |
| | Silica - Gold Bond "R" | 14.31 |
| | Titanium Dioxide | 2.38 |
| | Water (Demineralized) | 15.94 |
| | Tamol 731 | 0.56 |
| | Moly White 212 | 3.80 |
| Cure | V-40 Polyamide Hardener | 8.53 |
| | Lignosulfonate Sodium | 1.32 |
| | Cellosolve Solvent | 8.53 |
| | Cement, Portland, White | 31.28 |
| | Calidra Asbestos | 0.28 |

The base component was prepared by emulsifying the 828 epoxy resin in water using the pluronic surfactant. The pigments were then added and the resultant grind base was dispersed using high shear aggitation until a Hegman reading of 4 was achieved. This mixture was permitted to cool. The cure component was made in similar fashion and allowed to cool. The base and cure components were mixed together in a 1:1 weight ratio. The resultant composition was found to be an easily sprayable consistency but the composition was applied in this example using a laboratory drawdown bar.

A sand blasted steel panel approximately 10 inches in width, 12 inches in height and ⅛ inch in thickness was given a primer coat of a partially hydrolyzed ethyl silicate zinc containing primer. The primer was allowed to set for two hours and it was then top coated with the epoxy-cement composition described in the previous paragraph. A similar panel was prepared and top coated with a conventional solvent type epoxy coating. After 24 hours cure, the two panels were examined. The panel top coated in accordance with the practice of this invention showed good adhesion and complete cure of the ethyl silicate primer, whereas the ethyl silicate primer which was top coated with the conventional epoxy coating was easily removed from the panel indicating incomplete cure of the primer.

We claim:

1. A method for top coating a partially hydrolyzed silicate film with a protective coating that will accelerate the cure rate of said partially hydrolyzed silicate film which comprises applying a coating composition comprising an epoxy resin and a curing agent, one of which is in an emulsion, and a hydraulic cement to said partially hydrolyzed inorganic silicate film.

2. A method as defined in claim 1 wherein said epoxy resin is the diglycidyl ether of bisphenol A.

3. A method as defined in claim 1 wherein said hydraulic cement is Portland cement.

4. A method as defined in claim 1 wherein said composition includes a thickening agent to impart thixotropy to said coating.

5. A method as defined in claim 1 wherein said coating has a thickness of 5 mils.

6. A method as defined in claim 1 wherein said epoxy resin and curing agent comprise from 15 to 80% by weight of the solids of said coating composition.

7. A method as defined in claim 1 wherein said composition contains a lignosulfonate hydrate inhibiting agent.

8. A method as defined in claim 1 wherein said composition contains a marine antifouling compound selected from the group consisting of tributyltin oxide, tributyltin acetate and tributyltin fluoride.

* * * * *